US005372306A

United States Patent [19]

Yianilos

[11] Patent Number: 5,372,306

[45] Date of Patent: Dec. 13, 1994

[54] FAIL SAFE LAWN SPRINKLER DEVICE

[76] Inventor: Nicholas P. Yianilos, 2807 NE. 36th St., Ft. Lauderdale, Fla. 33308

[21] Appl. No.: 952,362

[22] Filed: Sep. 28, 1992

Related U.S. Application Data

[63] Continuation-in-part of Ser. No. 676,786, Mar. 28, 1991, Pat. No. 5,174,500.

[51] Int. Cl.[5] ..... B05B 15/06; B05B 1/30

[52] U.S. Cl. ..... 239/201; 239/570; 137/68.1; 251/149.1

[58] Field of Search ..... 239/201, 202, 569, 588, 239/570, 572, 533.15; 251/149.1, 149.4; 285/1, 33, DIG. 921; 137/68.1, 71

[56] References Cited

U.S. PATENT DOCUMENTS

| | | | |
|---|---|---|---|
| 2,048,388 | 7/1936 | Johnsen | 137/68.1 |
| 4,018,386 | 4/1977 | Barichello | 239/588 |
| 4,314,717 | 2/1982 | Bjurman | 239/201 |
| 4,562,962 | 1/1986 | Hartman | 239/569 |
| 4,691,941 | 9/1987 | Rabushka et al. | 285/1 |
| 4,762,140 | 8/1988 | Davis | 137/68.1 |
| 4,827,977 | 5/1989 | Fink, Jr. | 285/1 |
| 4,842,198 | 6/1989 | Chang | 239/200 |
| 4,848,661 | 7/1989 | Palmer et al. | 137/68.1 |
| 4,852,602 | 8/1989 | McKinnon | 137/68.1 |
| 4,899,792 | 2/1990 | Podgers | 137/68.1 |

*Primary Examiner*—Andres Kashnikow
*Assistant Examiner*—Christopher G. Trainor
*Attorney, Agent, or Firm*—Dorn, McEachran, Jambor & Keating

[57] ABSTRACT

A sprinkler head assembly for a lawn sprinkler system includes a valve having a valve actuating member which is engaged by the sprinkler head when the sprinkler head is in place, holding the valve in an open condition, permitting water flow to the sprinkler head. When the sprinkler head is removed the valve is operated to a closed condition, cutting off water flow. The valve member has tabs that, upon operation to the closed condition, retain the valve member in that condition. The valve is made of material allowing the sprinkler head to break away from the valve without damage to either part.

4 Claims, 2 Drawing Sheets

FAIL SAFE LAWN SPRINKLER DEVICE

CROSS-REFERENCE TO RELATED APPLICATION

This is a continuation-in-part of application Ser. No. 07/676,786, filed Mar. 28, 1991, now U.S. Pat. No. 3,174,500.

BACKGROUND OF THE INVENTION

This invention relates to lawn sprinkler systems, and more particularly to an improved sprinkler head assembly for such systems.

In lawn sprinkler systems, water supply pipes are buried in the lawn slightly below ground level and water taps or outlets are provided at a plurality of locations, each tap having a sprinkler head located near ground level for directing the supply of water to the lawn in which the lawn sprinkler system is installed. The sprinkler heads both limit the rate of flow of water from the water supply pipes and define a spray pattern typically over an area 360° around the sprinkler head. Because the sprinkler heads and risers are located above or slightly below ground level, the sprinkler heads may be knocked off inadvertently due to being struck by a lawn mower, because of vandalism, or for other reasons. If, for any reason, a sprinkler head is not in place when water under pressure is supplied to the water supply pipes of the lawn sprinkling system, water will flow freely and uncontrolled through the tap that is missing its associated sprinkler head. This will result both in waste of water, and in the flooding with water of a very small area of the lawn which could result in damage to the lawn, plants and the subsoil. The waste of water and the potential damage to a lawn could be extensive for lawn sprinkler systems controlled by a timer. In such systems, water is supplied to the water supply pipes automatically and periodically and wasting of water could continue unnoticed for extended periods of time.

SUMMARY OF THE INVENTION

It is therefore an object of the present invention to provide an improved sprinkler head assembly for use in lawn sprinkler systems. The assembly automatically prevents the free flow of water through the sprinkler head assembly in the event a sprinkler head is removed either intentionally or unintentionally.

Another object of the invention is to provide an improved sprinkler head assembly for use in lawn sprinkler systems including a sprinkler head and a flow control assembly which controls and/or stops the flow of water through a tap if the sprinkler head is not in place.

Another object of the invention is a sprinkler head assembly of the type described in which the flow control assembly remains in the closed condition once actuated, even if the water pressure in the main supply line is reduced or removed.

A further object of the invention is a sprinkler head assembly having a breakaway connection between the sprinkler head and shut-off valve so that shock loading of the sprinkler head will cause separation of the head from the valve without damage to either component.

Another object of the invention is a sprinkler head assembly in which the flow control assembly introduces very little resistance to the motion of the valve closing member, until the valve is very nearly closed. One of the improvements of this invention is the observation that pressure is maximized at the time the valve is very nearly closed. Thus, by introducing resistance only near the end of the travel, a more positive actuation may result and the process of actuation does not interfere with the primary function of the valve, i.e., to prevent uncontrolled water flow.

These and other objects of the invention are achieved by the present invention which provides a sprinkler head assembly for use in lawn sprinkler systems of the type including a water supply pipe having a plurality of taps. The sprinkler head assembly comprises valve means in series with the tap and the sprinkler head. The valve means is operable between a water flow permitting position and a water flow preventing position. The sprinkler head maintains the valve means in its flow permitting position, but the valve means is operated to its flow preventing position by water pressure whenever the sprinkler head is not in place.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF PREFERRED EMBODIMENTS

Figure 1:
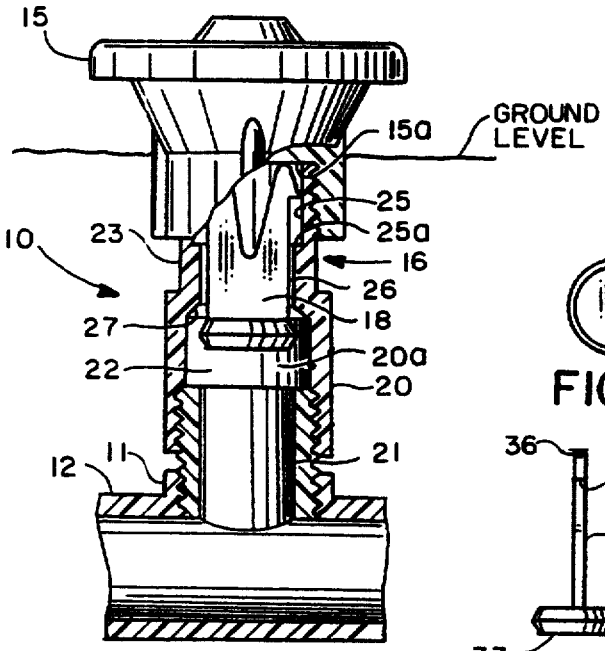
FIG. 1 is a side elevational view, partially in section, of a sprinkler head assembly provided by the present invention, shown mounted on a tap of a water supply pipe of a lawn sprinkler system.
Figure 2:
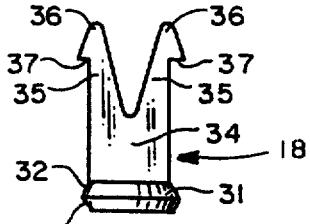
FIG. 2 is a front elevational view of a valve member of the sprinkler head assembly illustrated in FIG. 1.
Figure 3:
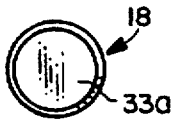
FIG. 3 is a bottom plan view of the valve member of FIG. 2.
Figure 4:
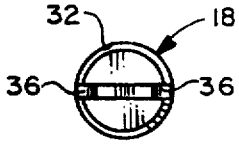
FIG. 4 is a top plan of the valve member of FIG. 2.
Figure 5:
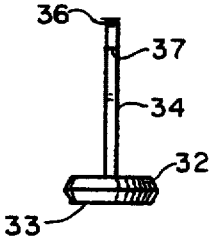
FIG. 5 is a side elevational view of the valve member of FIG. 2.

Referring to FIG. 1, the sprinkler head assembly provided by the present invention is indicated generally by reference number 10 and is shown mounted on a tap 11 of a water supply pipe 12 of a lawn sprinkler system. The water supply pipe 12 is embedded slightly below ground level as is known in the art. The sprinkler head assembly 10 includes a sprinkler head 15 which is located near ground level. Although only one sprinkler head assembly 10 is illustrated in FIG. 1, it is apparent that a plurality of such sprinkler head assemblies would be provided, each mounted on an individual tap of a water supply pipe of a network of water supply pipes which are embedded in a lawn. The sprinkler head 15 is conventional.

The sprinkler head assembly 10 includes the sprinkler head 15 and a valve assembly 16 which couples the sprinkler head 15 to the tap 11. The valve assembly 16 includes a valve member 18, a coupling member 20, and a short nipple 21. The coupling member 20 is connected to the tap 11 by the nipple 21 and has male threads at its upper end which engage female threads on the sprinkler head 15. The valve member 18 is located within a central axial bore 20*a* of the coupling member 20 and movable axially thereof in a vertical direction between an open or flow permitting position illustrated in FIG. 1 and a closed or flow preventing position illustrated in FIG. 6, as will be shown. The sprinkler head 15 maintains the valve member 18 in its flow permitting position as illustrated in FIG. 1. However, when the sprinkler head 15 is not in place on the assembly as illustrated in FIG. 6, the valve member 18 is free to move in response to the flow of water through the tap 11 to its flow preventing position, as illustrated in FIG. 6, when water under pressure is being supplied to the water supply pipe 12.

Figure 6:
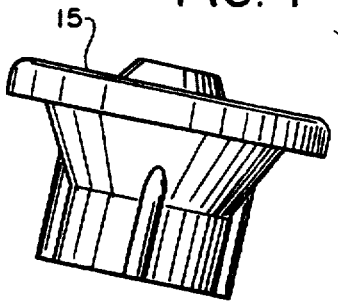
FIG. 6 is a view similar to FIG. 1 but with the sprinkler head removed and the valve illustrated operated to its flow preventing condition.
Figure 6:
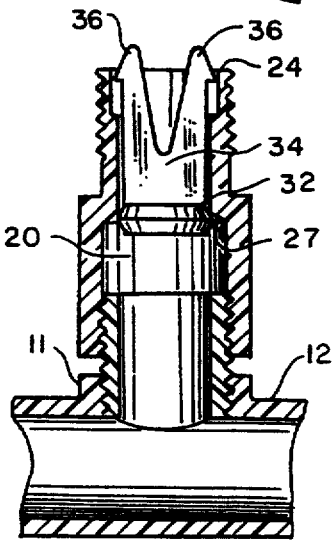
Figure 7:
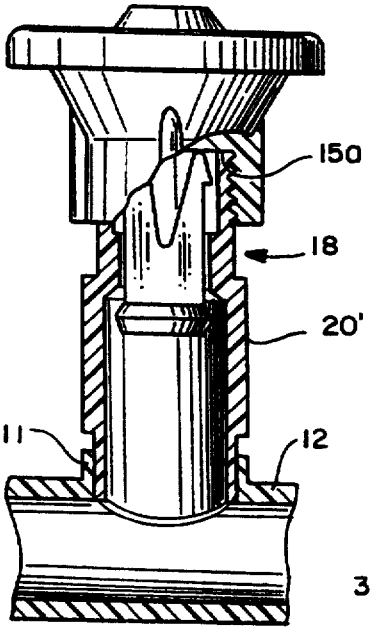
FIG. 7 is a side elevational view, partially in section, of a further embodiment for a sprinkler head assembly provided by the present invention.

Referring to FIGS. 1 and 6, the coupling member 20 is hollow and generally cylindrical in shape defining a water inlet compartment 22 at its lower edge. The coupling member 20 has a necked down upper portion 23 which is counter sunk near its upper edge 24 defining an enlarged annular bore 25 with a shoulder 25*a* at its lower end. The annular bore 25 is communicated with the water inlet compartment 22 through a narrow inner diameter portion 26 of the coupling member. The portion 27 of the inner wall of the coupling member adjacent to its reduced diameter portion 26 is tapered, defining a valve seat for the valve assembly 16. The coupling member 20 and the nipple 21 are molded of plastic or other suitable material. Although the coupling member 20 and the nipple 21 are shown in FIG. 1 as separate elements, they may be molded as a one-piece plastic member 20', as illustrated in FIG. 7.

Referring to FIGS. 2-5, the valve member 18 includes a base portion 31 which is generally frustoconical in shape and defines a tapered sealing surface 32 extending vertically upward and inwardly from an annular base portion 33. The valve member 18 has a flat, generally circular bottom 33*a*. The valve member 18 is bifurcated and includes a yoke 34 having a pair of upwardly extending leg members 35 which terminate in generally triangular shaped cam tip portions 36. The cam portions 36 increase in width from top to bottom of the leg members, defining overhang portions 37.

As shown in FIGS. 1 and 6, the overhang portions 37 of the triangular tip portions 36 extend into the annular bore 25 of the coupling member 20 and the undersides of the overhang portions 37 rest on the shoulder 25*a* of coupling member 20 when the valve member 18 is in its flow permitting position. The transverse width of the valve member 18, measured at the overhang portions 37 of its tips, corresponds to the inner diameter of the annular bore 25 of the coupling member.

Referring to FIGS. 1 and 6, the sprinkler head assembly 10 is mounted on the tap 11 of the water supply pipe 12 as shown in FIG. 1. In the absence of water flow through the supply pipe 12, the tip portions 36 of the valve member 18 rest on the shoulder 25*a* of the coupling member. When water is being supplied to the tap 11 through the water supply pipe 12, the water pressure will move the valve member 18 vertically upwardly, slightly, until the tip portions 36 engage the undersurface 15*a* of the sprinkler head 15, permitting water to flow through the tap 11 around the valve head portion 32 and through the reduced diameter portion 26 of the coupling member 20 and the bore 25 to the inlet of the sprinkler head 15. Water thus supplied to the sprinkler head 15 flows out through the sprinkler head 15 in the pattern established by the sprinkler head.

When the sprinkler head 15 is in place and its undersurface 15*a* engages the legs 35, upward travel of the valve member 18 is limited so as to maintain the valve head 32 out of engagement with the valve seat 27.

If the sprinkler head 15 is not in place on the tap as illustrated in FIG. 6, the valve member 18 is permitted to move upwardly under the force of water supplied through the water supply pipe 12 to its flow preventing position such that its valve surface 32 engages the valve seat 27, sealing the outlet through the reduced diameter portion 26 and bore 25 of the coupling member 20. This shuts off the flow of water through the tap 11. Thus, the sprinkler head assembly 10 with the valve assembly 16 according to the present invention, permits water to flow out of the tap 11 only when the sprinkler head 15 is in place.

Figure 8:
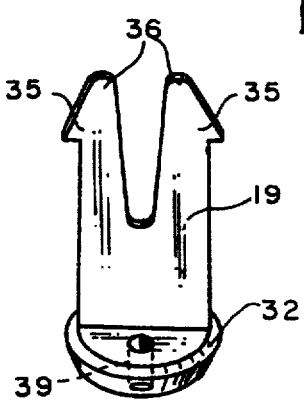
FIG. 8 is a front elevational view of another embodiment for a valve member for a sprinkler head assembly provided by the present invention.

In some instances, it may be desirable to have some indication that the sprinkler head 15 is not in place. Accordingly, as illustrated in FIG. 8, there is provided a valve member 19 which has an aperture 39 through the base portion of the valve element, so that when the valve member 19 is operated to its valve closing or water flow preventing position illustrated in FIG. 6, a trickle of water is permitted to flow through the aperture 39. This water flow provides an indication of the absence of a sprinkler head 15 at that position.

Figure 9:
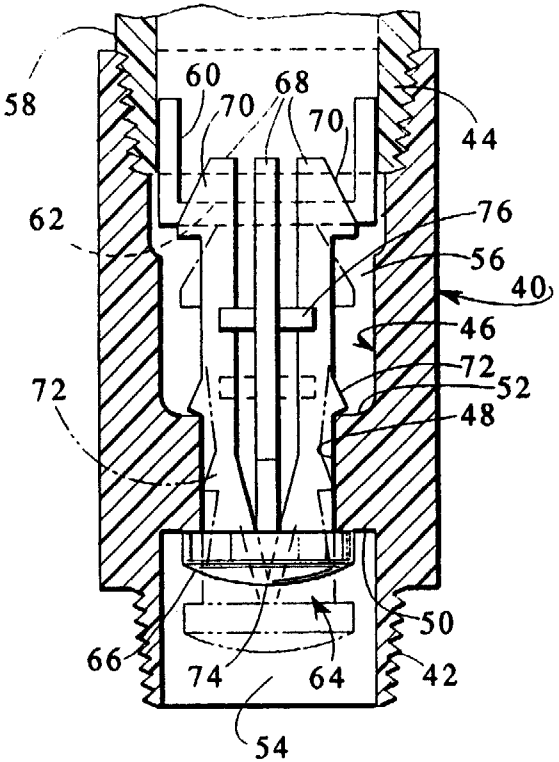
FIG. 9 is a side elevation view, partially in section, of another embodiment of the present invention. The valve closing member is shown in its open position in phantom lines and in its closed position in solid lines.

FIG. 9 illustrates an alternate embodiment of the invention. A valve assembly has a generally hollow coupling member or valve body 40. The body has lower, external threads 42 and upper, internal threads 44. The upper threads form a gripping means for releasably joining the sprinkler head and valve. While the gripping means in this embodiment is integrally formed in the body, it will be understood that it could be a separate piece attached in a suitable manner to the rest of the valve body.

The valve body 40 defines a central, axial bore 46 and has a shoulder 48 of narrowed inner diameter. The shoulder forms a valve seat 50 at its lower surface and a retainer seat 52 at its upper surface. The shoulder divides the bore 46 into a water inlet compartment 54 located below the shoulder and a water outlet compartment 56 located above the shoulder.

At least the gripping means, and in this case the entire body, is made of polymeric material having a low flexural modulus and low specific gravity. By this it is meant that the desired range for the flexural modulus is about 3200 PSI, with a density near 0.920, and elongation to break around 500%. For example, a blend of 90% branched polyethylene homopolymer and 10% ethylene vinyl acetate copolymer has been found to be suitable. This material is sufficiently flexible to give the gripping means the ability to separate from the sprinkler head or a riser pipe without damage to either. This is sometimes referred to as a breakaway capability. In other words, the body and sprinkler head or riser are re-usable, even after the occurrence of an unintentional separation of the assembly.

The lower threads 42 connect the body 40 to a tap in the water supply pipe. The tap is not shown but is similar to the ones shown at 11 in FIGS. 1 and 6. The upper threads 44 engage the lower end of a riser pipe 58. The riser carries the sprinkler head (not shown) at its upper end. The lower end of the riser pipe is fitted with a push-in riser plug 60. The bottom surface 62 of the plug 60 has an aperture to permit water flow from the valve body to the riser pipe when the plug is in place.

A valve member 64 is disposed in the bore 46 of the valve body 40. It has a valve head 66 in the water inlet compartment 54. Four legs 68 span the shoulder 48 and extend into the water outlet compartment 56. Two of the legs have hooks 70 formed at their ends in the water outlet compartment. Those same legs have retainer means in the form of tabs 72 intermediate the valve head 66 and hooks 70.

Figure 10:
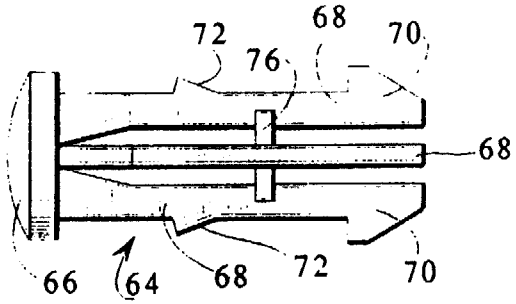
FIG. 10 is a side elevation view of the valve closing member of the FIG. 9 embodiment.
Figure 12:
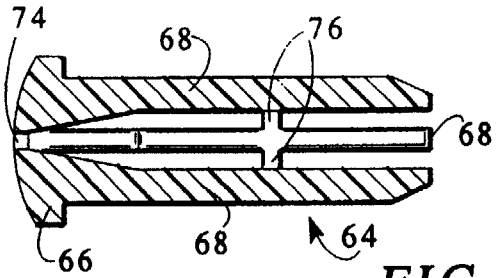
FIG. 12 is a section taken along line 12—12 of FIG. 11.
Figure 11:
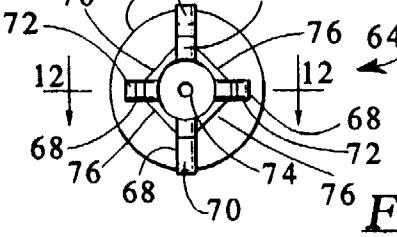
FIG. 11 is an end view of the valve closing member.

Further details of the valve member 64 are shown in FIGS. 10–12. They include a telltale hole 74 through the center of the head 66. Its purpose is the same as the aperture 39. Stiffening ribs 76 join the legs 68. A central, cross-shaped rib could be substituted for the four individual ribs shown. Whatever rib configuration is used, the legs remain sufficiently flexible to permit the hooks 70 to flex past the shoulder 48 during installation of the valve member and to allow the tabs 72 to slide on the shoulder during valve closure.

The use, operation and function of the valve assembly of FIG. 9 are as follows. When the riser 58 is in its intended position on the valve body the bottom surface 62 of the riser plug 60 contacts the tips of the legs 68. This prevents upward movement of the valve member 64 under the influence of water pressure. The valve member assumes the position shown in phantom lines in FIG. 9. Accordingly, the valve head 66 is held spaced from the valve seat 50 and water flows freely from the inlet compartment 54, past the spaced-apart legs 68 in the area of the shoulder 48, to the outlet compartment 56 and beyond.

If the riser 58 is removed from its connection to the gripping means 44, the riser plug 60 no longer restrains upward movement of the valve member 64. Water pressure raises the valve member 64 to the position shown in FIG. 9, with the valve head 66 contacting the valve seat 50, thereby shutting off the flow of water through the valve body. When the valve member reaches the closed position, the tabs 72 engage the retainer seat 52. This prevents reopening of the valve upon removal of the water pressure. The valve must be manually reset to its open condition. This one-way activation prevents entry of dirt or other contaminants into the water inlet compartment 54. As mentioned above, the legs 68 are sufficiently flexible to permit the tabs 72 to slide on the shoulder 48 during closing movement, and once past the retainer seat 52 the tabs pop out to engage the seat and prevent the valve member from falling back in the body.

Figure 13:
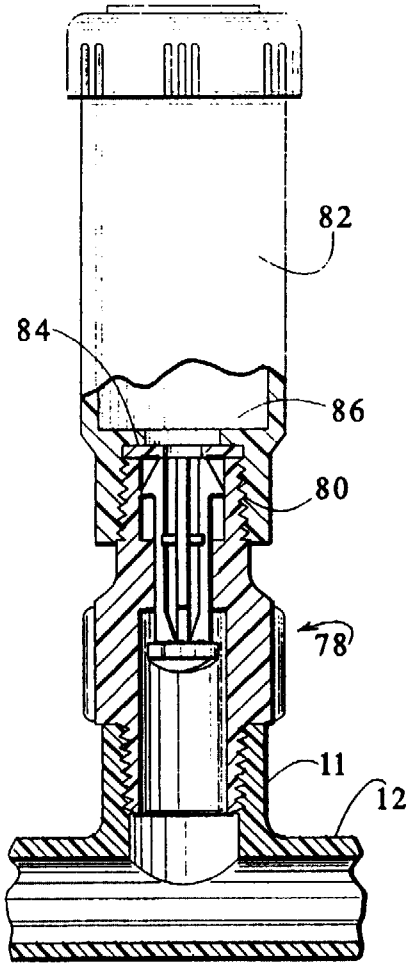
FIG. 13 is a side elevation view, partially in section, of a further embodiment of the invention.

Another embodiment of the invention is shown in FIG. 13. This embodiment is similar to FIG. 9 so the description of like parts will not be repeated. Here the gripping means of the valve body 78 comprises integral external threads 80. These engage the internal threads of a popup sprinkler head 82. A self-locking orifice adaptor 84 is trapped between a flange 86 of the sprinkler head and the top land of the threads 80. The adaptor serves the same purpose as the riser plug 60. The adaptor has a central opening to permit water flow while preventing upward movement of the valve member. The valve member used here is the same as in FIGS. 9–12. The valve body is made of the material noted above to give the gripping means 80 the desired breakaway characteristic.

While several forms of the invention have been shown and described, it will be understood that alterations may be made thereto without departing from the scope of the following claims. For example, instead of employing a true locking means as shown, a friction fitting could be employed that makes reverse motion difficult but not impossible. In other words, the valve member moves easily to a closed position but reverse motion to an open position is much more difficult.

I claim:

1. In a sprinkler system of the type having a water supply pipe having a plurality of taps and sprinkler head assemblies connected to the taps, said assemblies including valves which shut off water flow through a tap in the event of removal of the associated sprinkler head, the improvement comprising a valve having breakaway gripping means for releasably joining the sprinkler head and valve such that severe shock loads on the sprinkler head will separate it from the valve without destroying either of them, the gripping means comprising a threaded portion of the valve, cooperable with mating threads formed on the sprinkler head, the gripping means being made of polymeric material having a low flexural modulus and low specific gravity.

2. The structure of claim 1 wherein the gripping means is made of a blend of 90% branched polyethylene homopolymer and 10% ethylene vinyl acetate copolymer.

3. The structure of claim 1 wherein the sprinkler head assembly includes a riser pipe connected between the gripping means and sprinkler head.

4. The structure of claim 1 wherein the gripping means is integrally formed in the valve.

* * * * *